US007640633B2

(12) United States Patent
Chou

(10) Patent No.: US 7,640,633 B2
(45) Date of Patent: Jan. 5, 2010

(54) BUCKLE SET OF SWIMMING GOGGLES

(75) Inventor: Shu-Fang Chou, Hsin Chuang (TW)

(73) Assignee: First Rank Co., Ltd., Taipei Hsien (TW)

( * ) Notice: Subject to any disclaimer, the term of this patent is extended or adjusted under 35 U.S.C. 154(b) by 376 days.

(21) Appl. No.: 11/696,803

(22) Filed: Apr. 5, 2007

(65) Prior Publication Data

US 2008/0244875 A1 Oct. 9, 2008

(51) Int. Cl.
*A44B 21/00* (2006.01)

(52) U.S. Cl. ..... 24/68 E; 24/170; 24/193

(58) Field of Classification Search ..... None
See application file for complete search history.

(56) References Cited

U.S. PATENT DOCUMENTS 190,666 A * 5/1877 Cate ..... 24/134 KB
432,539 A * 7/1890 Mains ..... 24/134 KB
1,146,934 A * 7/1915 Gleeson ..... 132/273
1,727,687 A * 9/1929 Agobian ..... 24/134 P
2,315,196 A * 3/1943 Gallione ..... 248/499
2,318,411 A * 5/1943 Moore ..... 24/712.7
2,554,184 A * 5/1951 Gerstenblith ..... 24/601.5
4,336,636 A * 6/1982 Ishiguro et al. ..... 24/115 M
4,607,398 A * 8/1986 Faulconer ..... 2/452
5,467,508 A * 11/1995 Feng ..... 24/68 SK
5,706,527 A * 1/1998 Kita et al. ..... 2/452
5,711,036 A * 1/1998 Kita et al. ..... 2/452
6,185,794 B1 * 2/2001 Maggi ..... 24/170
6,189,186 B1 * 2/2001 Boden ..... 24/129 R
6,350,030 B2 * 2/2002 Fujima ..... 351/43
6,546,601 B1 * 4/2003 Kawashima ..... 24/200
D498,784 S * 11/2004 Cleary et al. ..... D16/339
6,817,068 B2 * 11/2004 Cleary et al. ..... 24/3.13
6,871,386 B2 * 3/2005 Chen-Lieh ..... 24/168
6,877,190 B2 * 4/2005 Berger ..... 24/196
6,966,102 B2 * 11/2005 Shiue ..... 24/196
7,458,134 B2 * 12/2008 Shiue ..... 24/68 E
2005/0034281 A1 * 2/2005 Shiue ..... 24/132 R
2007/0256283 A1 * 11/2007 Chiang ..... 24/193
2008/0072366 A1 * 3/2008 Fukasawa ..... 2/445
2008/0289160 A1 * 11/2008 Chou ..... 24/68 R

* cited by examiner

*Primary Examiner*—Jack W. Laivnder
(74) *Attorney, Agent, or Firm*—Rabin & Berdo, P.C.

(57) ABSTRACT

A buckle set, which fits onto a strap for adjusting the strap to a desired length, generally fits onto the strap attached to goggles of almost any application, such as swimming goggles, scuba mask, or dust and wind goggles. Specifically, a buckle set allows a strap to easily and quickly be adjusted to a desired length from its two ends.

5 Claims, 5 Drawing Sheets

BUCKLE SET OF SWIMMING GOGGLES

BACKGROUND OF THE INVENTION

I. Field of the Invention

The present invention relates to a buckle set, in which a strap is inserted for length adjustment, and specifically to a buckle set that allows the strap to be adjusted to a desired length from its two ends.

II. Description of the Prior Art

The buckle that fits onto a strap is commonly used to adjust the strap to a desired length. Among various buckles, tri-glide or vertical flip are the most popular. With reference to FIG. 1, which shows a tri-glide buckle of the prior art, the tri-glide buckle 102 fits onto a strap 103 attached to a pair of swimming goggles 101. As shown in FIG. 1, the strap is inserted into two slots respectively formed on two sides of the sealing frame of swimming goggles 10, and two ends of the strap 103 are inserted into the holes 1021 formed on the tri-glide buckle 102 so that the strap can be adjusted to a desired length.

Accordingly, the tri-glide buckle 102 can be positioned on a strap so as to set the strap to a desired length, the strap easily comes off the tri-glide buckle 102 though. The strap 103 is made of rubber and has its two ends inserted in the tri-glide buckle 102. When its two ends are pulled for length adjustment, the strap rebounds because of the rebound property resulting from its elasticity and would consequently come off the tri-glide buckle 102

SUMMARY OF THE INVENTION

In view of the foregoing drawbacks, it is desirable to develop a buckle design that substantially meets user demands and improves convenience and effectiveness in use. The main objective of the present invention is to provide a buckle set that is user-friendly and can be firmly positioned on a strap so as to set the strap to a desired length.

The buckle set provided by the present invention generally comprises three parts, namely a buckle seat, a buckle composed of two corresponding clasps, and a buckle hood. Insert two ends of a strap into said clasps so that the strap can be set to a desired length.

Desirable structure, assembly, and features of the present invention will be better understood from the detailed description and drawings that follow, in which various embodiments of the disclosed invention are illustrated by way of example.

DESCRIPTION OF THE PREFERRED EMBODIMENTS

Figure 1:
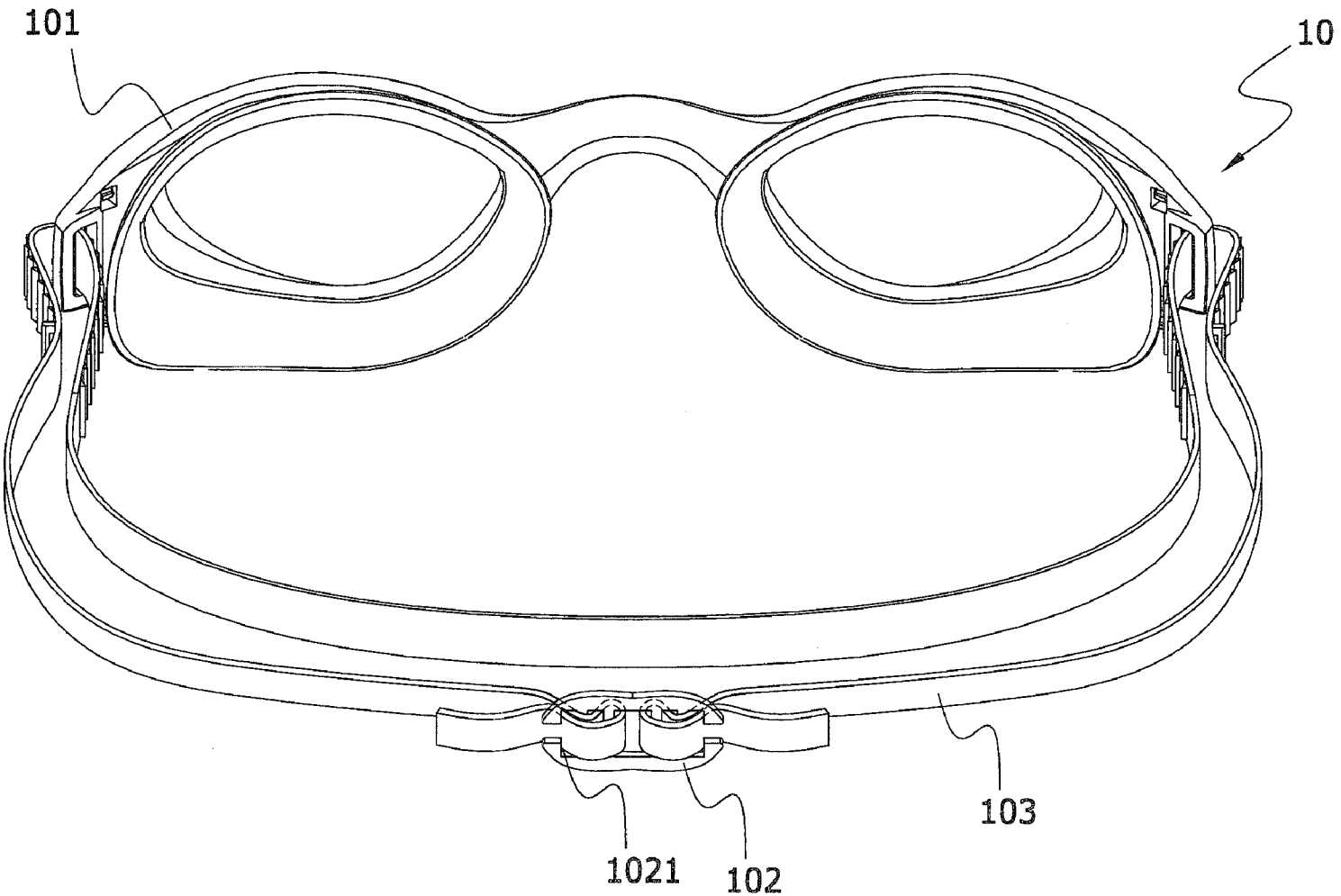
Fig.1(PRIOR ART)
FIG. 1 shows a buckle of the prior art.
Figure 2:
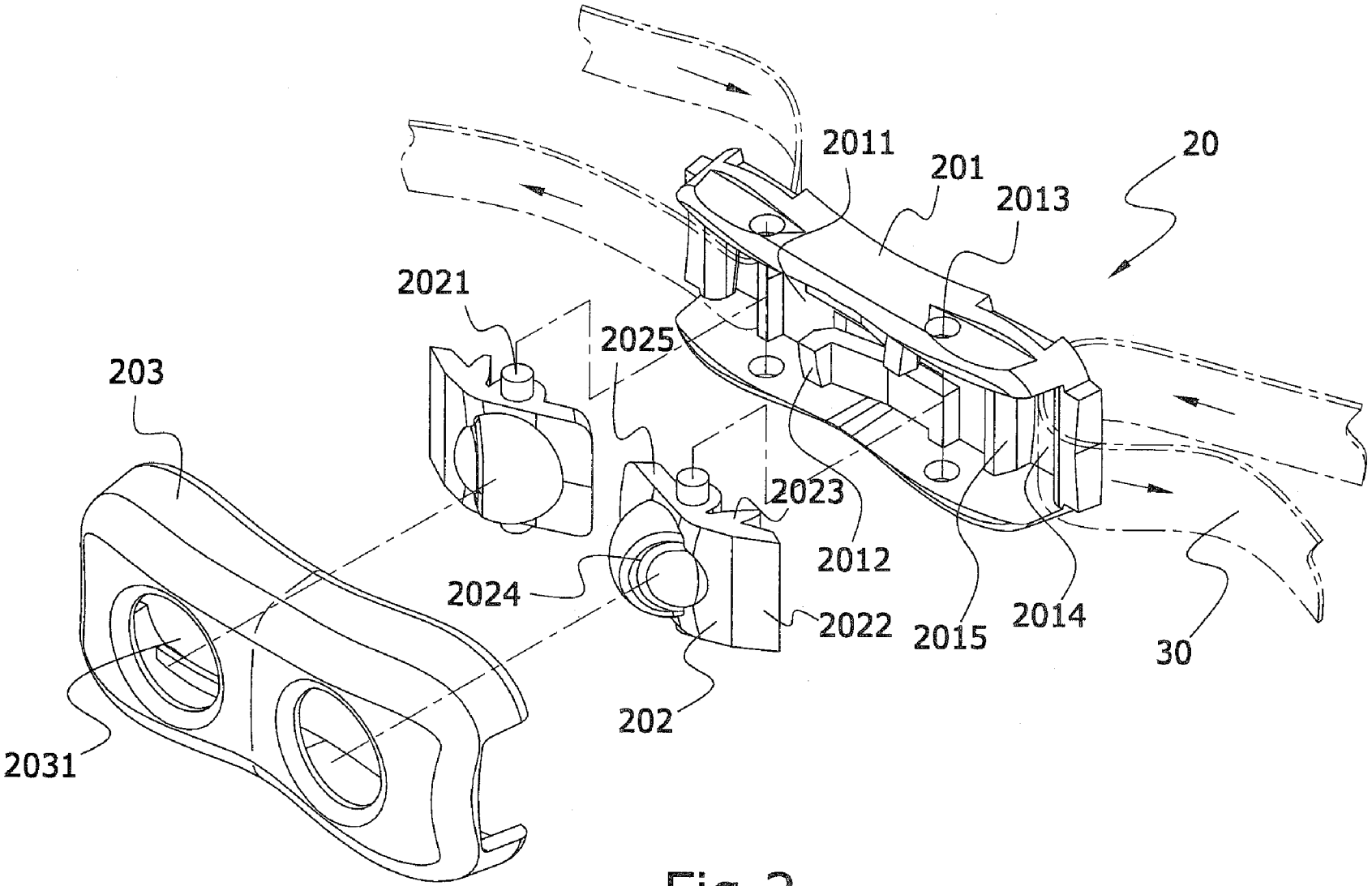
FIG. 2 shows a three-dimensional view of the invention.

With reference to FIG. 2, which shows a three-dimensional view of the present invention, the buckle set 20 comprises a buckle seat 201, a buckle 202, and a buckle hood 203. The buckle seat 201 is mainly structured by a receptor 2011 that comprises a plurality of springs 2012, barriers 2015, pivot slots 2013, and two strap slots 2014. The barriers 2015 are formed nearby the springs 2012. The pivot slots 2013 are formed on flanks of the buckle seat 201. The strap slots 2014, into which the strap 30 is inserted, are formed on two ends of the buckle seat 201 respectively. The buckle 202 is composed of two corresponding clasps, each of which comprises a press stud 2024, two pivots 2021, two bumps (the first bump 2025 and the second bump 2023) and a pressing portion 2022. The first bump 2025 and the pressing portion 2022 are formed respectively on two ends of the buckle 202. The second bump 2023 is positioned between the pressing portion 2022 and the pivot 2021. The buckle hood 203 is a removable cover over the buckle seat 201 that comprises a pair of holes 2031. Ensconce the buckle 202 into the buckle seat 201 that the first bump 2025 is positioned against the spring 2012 and the second bump 2023 against the barrier 2015. Fit the buckle hood 203 onto the buckle seat 201, in which the buckle has fit in, the press studs 2024 would partially protrude from the holes 2031 so as to be pressed by one's thumbs.

Figure 3:
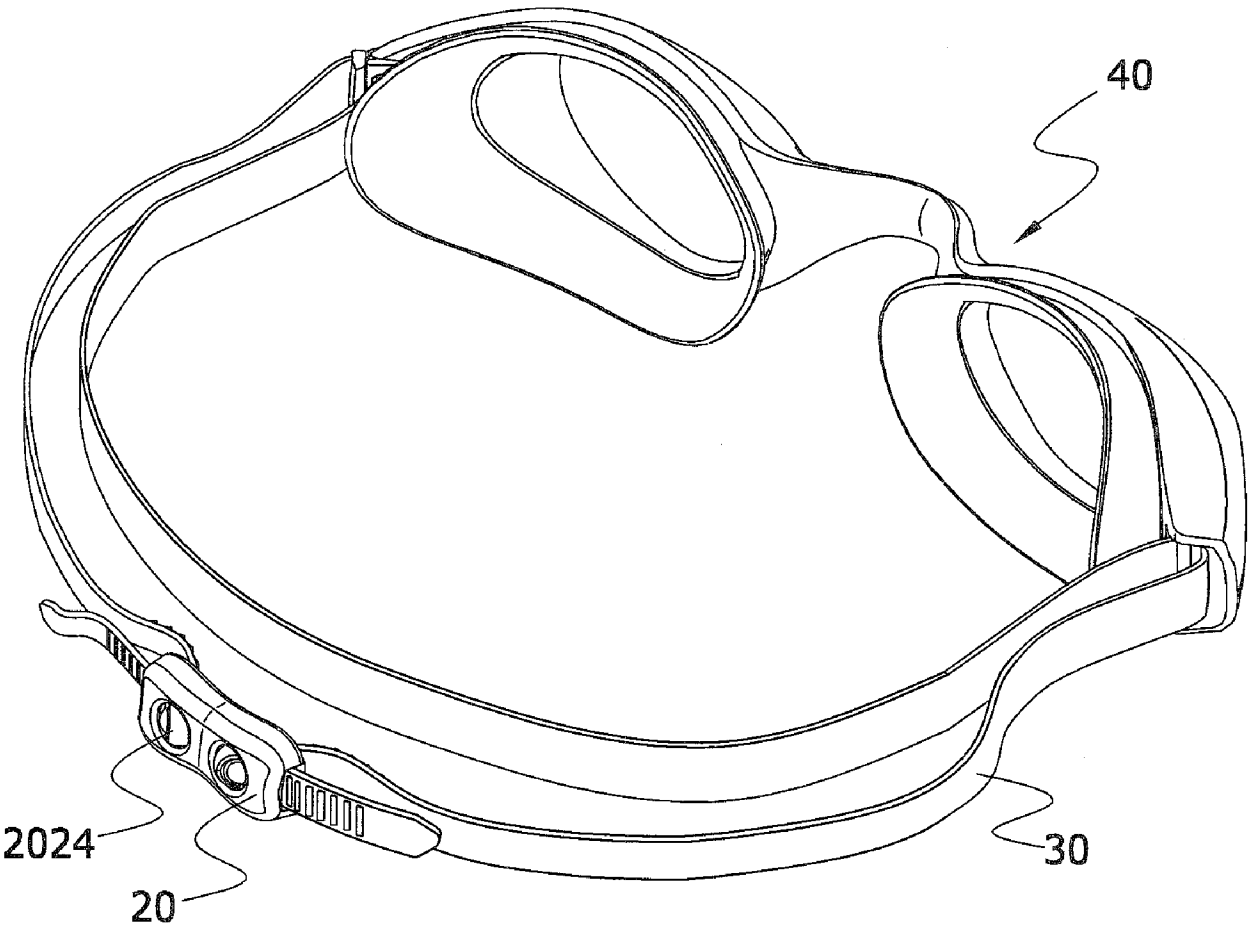
FIG. 3 shows an embodiment of the invention.

With reference to FIG. 3, which shows an embodiment of the present invention, the buckle set 20 fits onto a strap attached to a pair of swimming goggles 40. By pressing the press studs 2024, the wearer can easily and quickly buckle up, unbuckle the buckle set 20, or adjust length of the strap.

Figure 4:
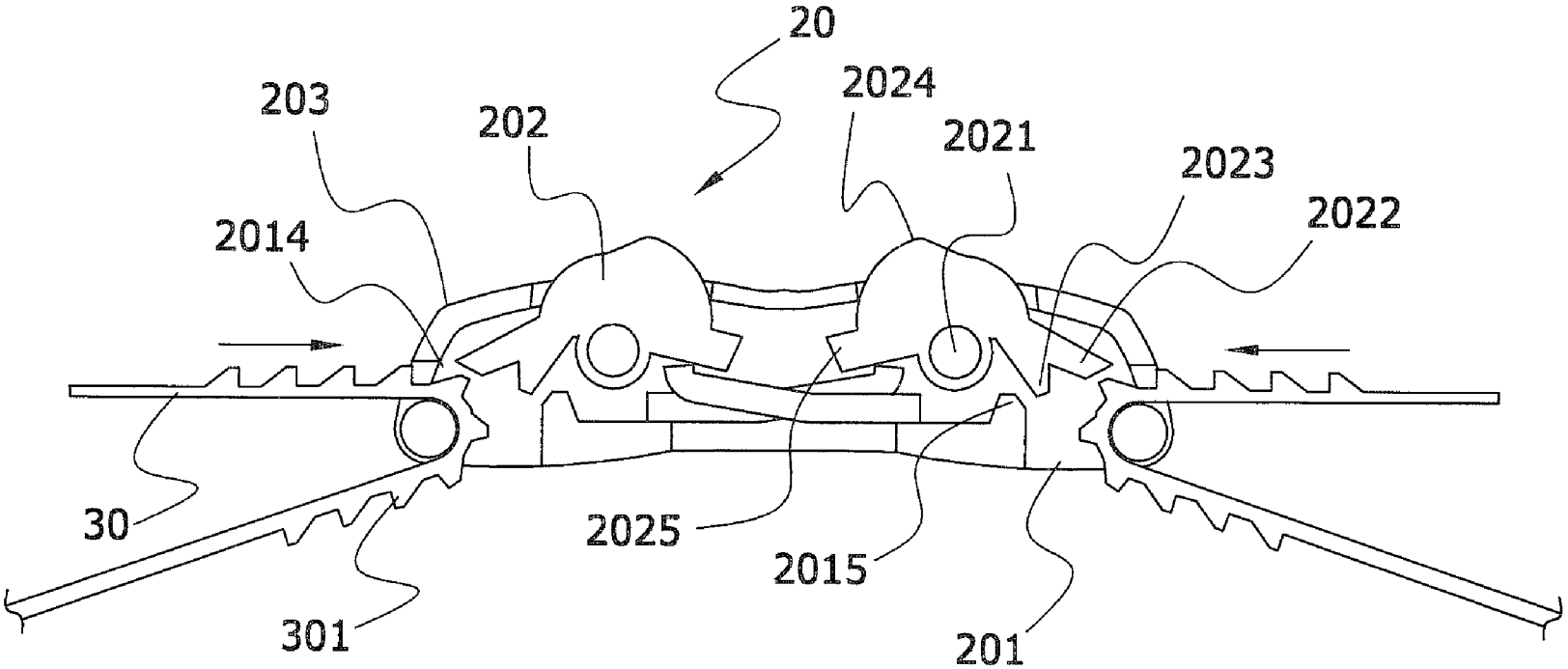
FIG. 4 shows unbuckling (I) of the invention.

With reference to FIG. 4, which shows unbuckling (I) of the present invention, the buckle set 20 comprises two strap slots 2014, in which two ends of the strap 30 are inserted. When the buckle 202 is unbuckled, the strap can run freely in the strap slots so as to easily and quickly be adjusted to a desired length. Also shown in FIG. 4, when the buckle 202 is unbuckled, the pressing portion 2022 of the buckle 202 is spaced apart from the strap 30 and the second bump 2023 from the barrier 2015 of the buckle seat 201. On the other hand, the first bump 2025 of the buckle 202 jostles against the spring 2012 of the buckle seat 201 so that the buckle 202 can be pushed back to its original position while the spring 2012 is rebounding by its elasticity.

Figure 5:
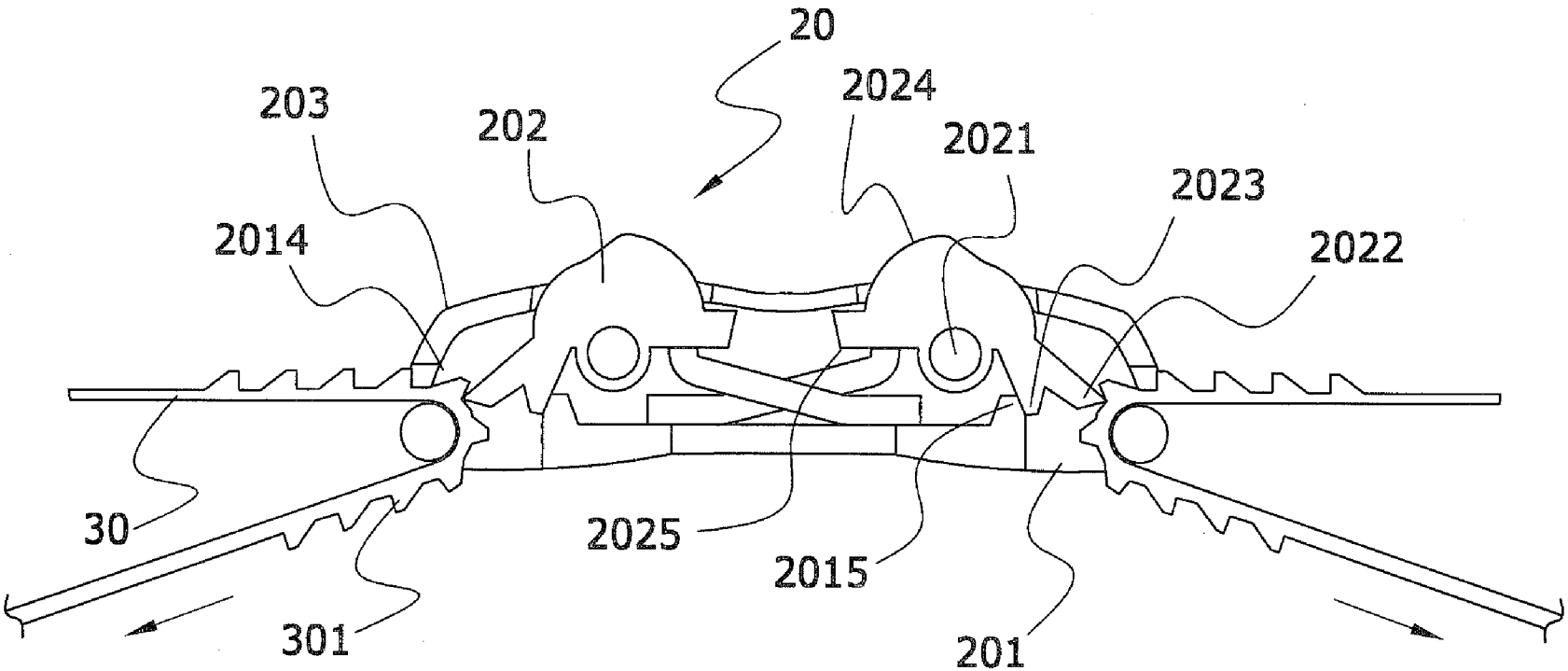
FIG. 5 shows buckling (II) of the invention.

With reference to FIG. 5, which shows buckling (II) of the present invention, the buckle set 20 is buckled up after the strap 30 is adjusted to a desired length. When the buckle 202 is buckled up to set the strap 30 at desired length, the strap 30 hardly comes off the strap slots because the pressing portion 2022 butts in one of the teeth 301 and the second bump 2023 jostles against the barrier 2015 of the buckle seat 201. The teeth 301 are formed on the surface of two ends of the strap 30. Moreover, pulling the strap 30 may cause a force in the direction as indicated by the arrow shown in FIG. 5. The force may push the second bump 2023 to further jostle against the barriers 2015 as well as cause the pressing portion 2022 to tightly press on the strap 30. As shown in FIG. 5, the buckle 202 is composed of two corresponding clasps, in which two ends of the strap 30 are inserted, so that the strap can be adjusted to a desired length from its two ends. The design of the two corresponding clasps favors users with an easy and effective way of adjusting length of a strap attached to swimming goggles from its two ends.

Accordingly, the present invention mainly uses a buckle that is composed of two corresponding clasps to facilitate the length adjustment of a strap that is attached to a pair of swimming goggles. Two ends of a strap are respectively inserted in said clasps so that the strap can be adjusted to a desired length from its two ends. In sum, the present invention achieves in providing a buckle set that is user-friendly and can be firmly positioned on a strap so as to set the strap to a desired length.

While the present invention is susceptible to various modifications and alternative forms, the specific embodiments have been shown by way of example in the drawings and described in detail herein. However, it should be understood that the present invention is not intended to be limited to the particular form disclosed. Rather, the present invention is to cover all modifications, equivalents, and alternatives falling within the spirit and scope of the present invention as defined by the appended claims.

What is claimed is:

1. An adjustable buckle set, in which a strap is inserted so as to be adjustable to a desired length, the buckle set comprising:

a buckle seat including a receptor, the receptor including a plurality of springs installed in an inner part thereof, a barrier positioned nearby said springs, two pivot slots formed on upper and lower flanks of the buckle seat, and two strap slots formed on two ends of the buckle seat;

a plurality of buckles, each of including a pivot formed on upper and lower flanks thereof, a first bump formed on one end, a pressing portion formed on another end, and a second bump formed nearby said pressing portion, the buckles being fitted in the buckle seat by aligning the pivots formed on the upper and lower flanks of the buckles with the pivot slots formed on the upper and lower flanks of the receptor and engaging the two together; and a buckle hood including a removable cover over the buckle seat forming a plurality of holes with the buckle seat from which the buckles partially protrude after the buckle hood is laid over the buckle seat into which the buckle is fitted.

2. The buckle set of claim 1, wherein the strap is inserted into slots formed on the bucket seat of swimming goggles.

3. The adjustable buckle set of claim 1, wherein the first bump of the buckle is positioned against the spring of the buckle seat when the buckle is fitted in the buckle seat.

4. The adjustable buckle set of claim 1, wherein the second bump of the buckle is positioned against the barrier of the buckle seat when the buckle is fitted in the buckle seat.

5. The buckle set of claim 1, wherein the strap is elastic and comprises a plurality of teeth.

* * * * *